United States Patent [19]

Brown

[11] Patent Number: 4,846,059

[45] Date of Patent: Jul. 11, 1989

[54] FILM REGISTRATION TABLE FOR FLEXIBLE PRINTING PLATES

[75] Inventor: Anthony J. Brown, Independence, Mo.

[73] Assignee: Press Ready Plate, Inc., Kansas City, Mo.

[21] Appl. No.: 144,571

[22] Filed: Jan. 15, 1988

[51] Int. Cl.[4] ..... B41F 27/06; B41F 27/12

[52] U.S. Cl. ..... 101/216; 101/DIG. 36

[58] Field of Search ..... 101/216, DIG. 12, 415.1, 101/212, 378; 33/184.5

[56] References Cited

U.S. PATENT DOCUMENTS

| | | | |
|---|---|---|---|
| 1,692,318 | 11/1928 | Week . | |
| 2,044,709 | 6/1936 | Lewis et al. . | |
| 2,711,691 | 6/1955 | Leavens, Jr. | 101/216 |
| 2,736,968 | 3/1956 | Faeber . | |
| 2,745,186 | 5/1956 | Faeber . | |
| 2,907,274 | 10/1959 | Taylor . | |
| 2,993,439 | 7/1961 | Rohrer | 101/247 |
| 3,186,336 | 6/1965 | Kirby . | |
| 3,550,283 | 12/1970 | Bernardi et al. | 101/DIG. 12 |
| 3,983,808 | 10/1976 | Jackson . | |
| 4,004,509 | 1/1977 | Mass . | |
| 4,019,434 | 4/1977 | Hoexter . | |
| 4,033,259 | 7/1977 | Schuhmann . | |
| 4,146,350 | 3/1979 | Bokelmann . | |
| 4,446,625 | 5/1984 | Hagan et al. | 101/DIG. 12 |
| 4,449,452 | 5/1984 | Mansell . | |
| 4,451,309 | 5/1984 | Cauldwell | 101/DIG. 12 |

*Primary Examiner*—J. Reed Fisher

*Attorney, Agent, or Firm*—Wm. Bruce Day

[57] ABSTRACT

A registration system for flexible printing plates includes a registration table which, when used in conjunction with a drill apparatus, makes registration and mounting of flexible printing plates on plate cylinders relatively quick and easy. The registration table includes a positioning apparatus against which a plate cylinder is situated. The positioning apparatus is aligned perpendicularly to a table track on which is slideably mounted a plate mounting platform to which the flexible plate is pinned. The plate mounting platform is swept along the track toward the plate cylinder and the flexible plate rolled onto the cylinder, and adhered by double sided sticky tape. The pins affixing the plate to the mounting platform are removed and the remaining plate material rolled onto the cylinder. The process ensures that a selected longitudinal axis of the plate will be in registration, or aligned, with the longitudinal axis of the cylinder.

9 Claims, 2 Drawing Sheets

FILM REGISTRATION TABLE FOR FLEXIBLE PRINTING PLATES

FIELD OF THE INVENTION

The present invention relates to apparatus for mounting printing plates on cylinders, and in particular, to registration and mounting means for affixing flexible printing plates on cylinders.

BACKGROUND OF THE INVENTION

When flexible printing plates, such as photopolymer plates, are mounted to print cylinders, a high degree of accuracy of the mounting of the plate to the cylinder is necessary so that the plate image is properly aligned, or registered. Extremely accurate standards must be followed in affixing the plate to the cylinder or the images on the finished work will be blurred and overlap.

One method of registration of the printing plate to the plate cylinder is by exacting hand work; however, this type of lay up is extremely time consuming and expensive.

To assist in applying the printing plate to the cylinder, some methods employ plate drills which form precisely positioned holes in the plate. The work is pinned through the holes to a mounting bar which is then used to connect the plate to the plate cylinder.

The CYREL Registration System of Dupont is directed toward a particular film and plate drill apparatus and a registration bar which fits on the plate cylinder and is used to apply the printing plate to the cylinder. This system is complex and expensive and the present system provides advantages of speed and economy over the CYREL Registration System.

One advantageous registration system is the subject matter of two pending patent applications of the present inventor, U.S. application Ser. No. 857,149, now U.S. Pat. No. 4,750,248, and an U.S. Divisional Patent application of Ser. No. 857,149. The patent applications are directed to a plate drill apparatus and a registration plate table respectively. This invention provides a related device within the same general concept of these earlier applications.

Although the present apparatus can be used in conjunction with any flexible printing plate, it is particularly advantageously used in connection with photopolymer printing plates, such as made by Dupont and other manufacturers.

OBJECTS OF THE INVENTION

The objects of the present invention are: to provide a registration table adaptable to different sizes of plates; to provide such a registration table which is adaptable to mount printing plates to various sizes of print cylinders; to provide such a registration table which fits the plate to a cylinder without requiring any adaptation to the plate cylinder; to provide a registration table which is small and handy, and which is a workable size for use in printing labels and tags, and for accommodating small sized printing plates; and to provide such a plate registation system which is relatively inexpensive and particularly well adapted for the intended purpose.

Other objects and advantages of this invention will become apparent from the following description taken in connection with the accompanied drawings wherein are set forth, by way of illustration and example, certain embodiments of this invention.

DESCRIPTION OF THE PREFERRED AND ALTERNATE EMBODIMENTS

Figure 2:
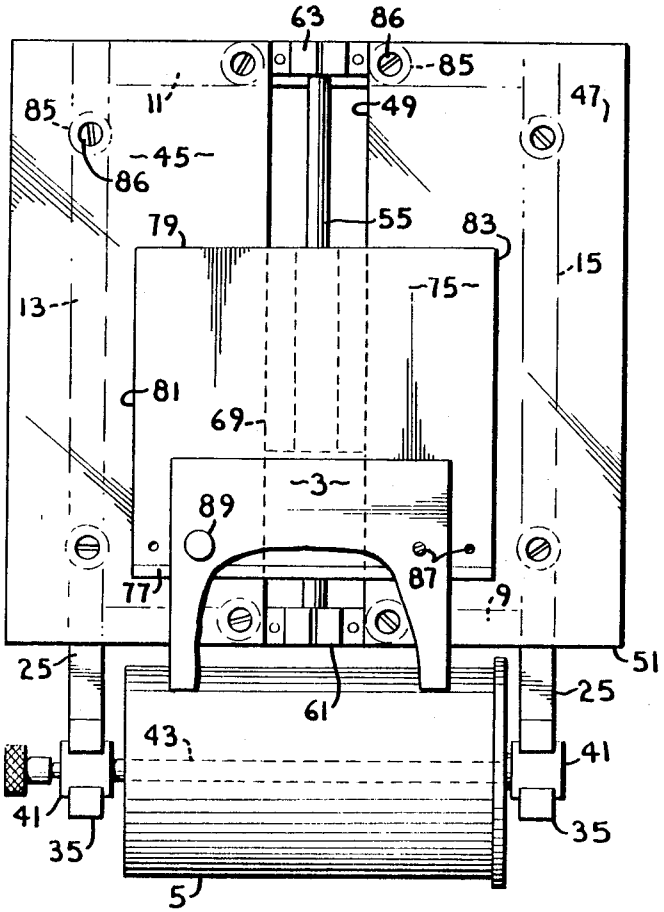
FIG. 2 is a plan view of a registration table embodying the present invention.

As required, detailed embodiments of the present invention are disclosed herein, however, it is to be understood the disclosed embodiments are merely exemplary of the invention which may be embodied in various forms, therefore, specific structural and functional details disclosed herein are not to be interpreted as limiting, but merely as a basis for the claims and as a representive basis for teaching one skilled in the art to variously employ the present invention in virtually any appropriately detailed structure.

Referring to the drawings in more detail:

The reference numeral 1, FIG. 2, generally indicates a registration table embodying the present invention. The registration table 1 is used in a process for mounting a printing plate to a plate cylinder and finds particular use in the flexographic printing process.

Figure 1:
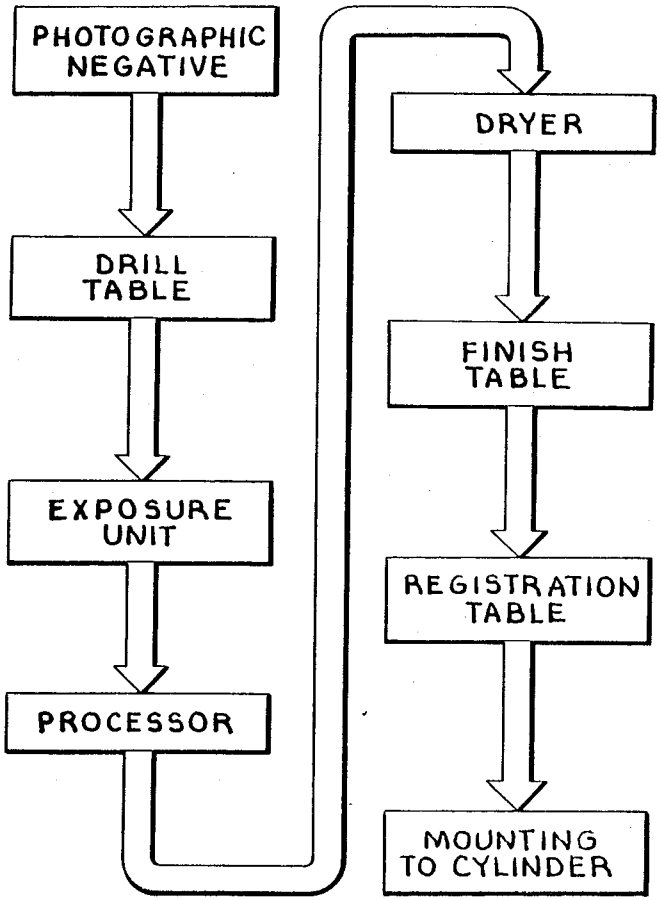
FIG. 1 is a schematic view of the steps taken in the process of preparing and mounting a printing plate to a plate cylinder.
Figure 4:
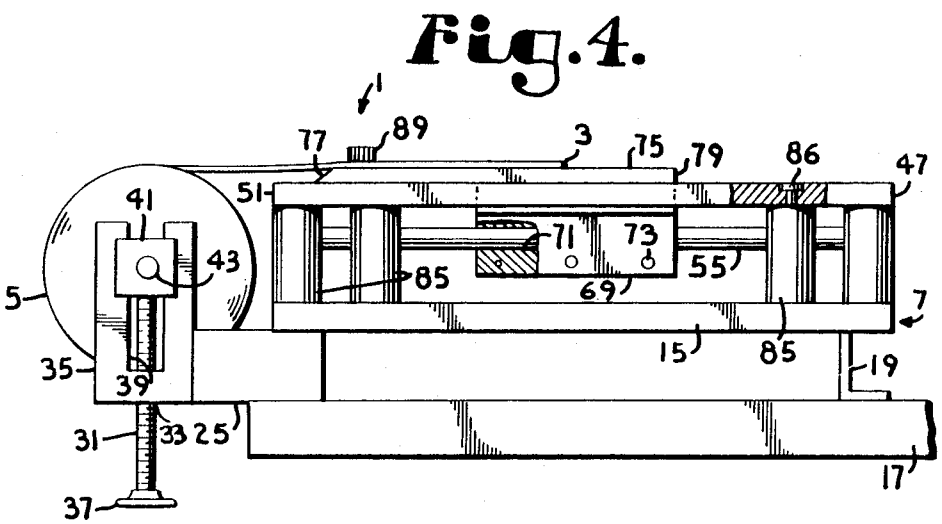
FIG. 4 is a side elevational view of the registration table with a plate cylinder positioned next to it.
Figure 6:
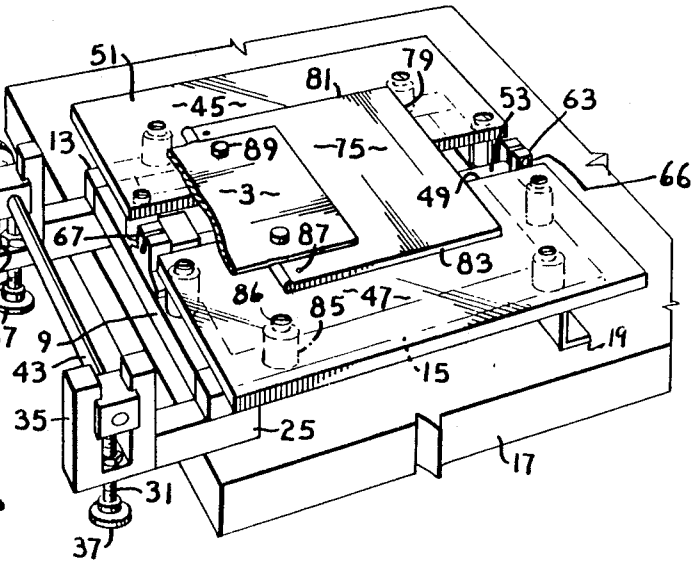
FIG. 6 is a perspective view of the registration table with a flexible printing plate positioned thereon.
Figure 3:
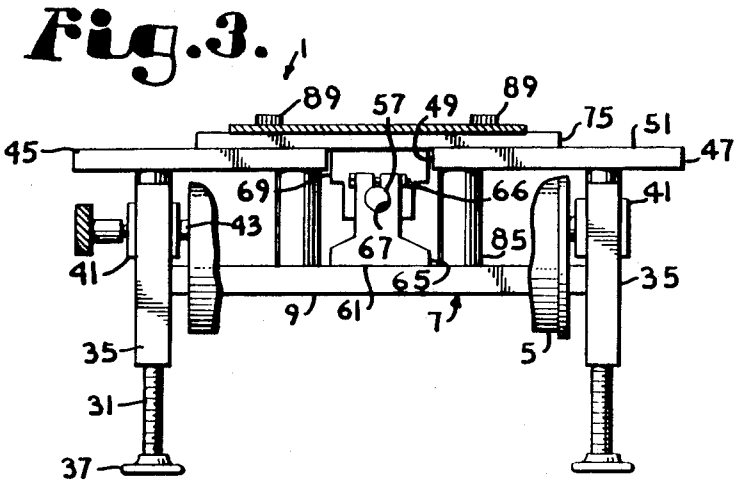
FIG. 3 is a front elevational view of the registation table embodying the present invention.
Figure 5:
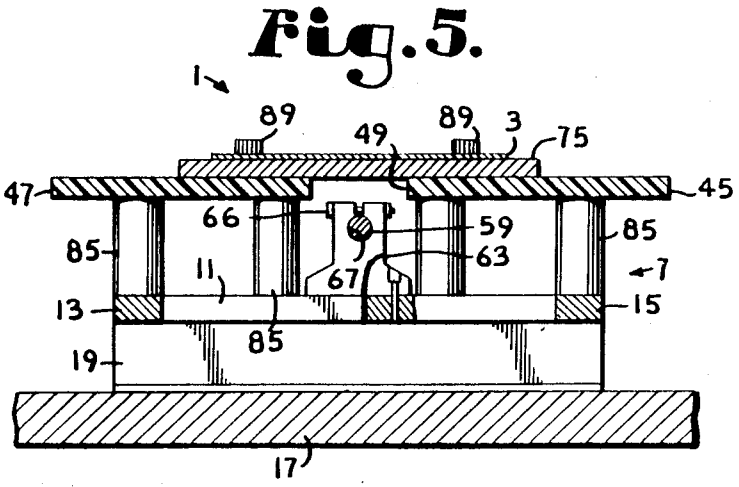
FIG. 5 is a rear elevational view of the registration table embodying the present invention.

Referring to FIG. 1, in the flexographic printing process, a photographic negative is made of the work to be printed and the negative, combined with an unexposed or undeveloped printing plate, is taken to the drill table or the drilling apparatus. There, the plate and the photographic film negative are drilled and then taken to an exposure unit which, in the flexographic printing process wherein a photopolymer plate is used, the exposure unit uses vacuum pressure to tightly engage the photographic negative to the plate and then expose the negative and the plate so the image of the work is transferred from the negative to the photopolymer plate. After exposure, the undeveloped plate is taken to a processor unit which, through a series of solvent washes, removes the unimaged portions of the printing plate to a depth selected on the basis of processing time. The photopolymer plate, with the image formed thereon, is now taken to a dryer unit which dries the sticky plate material. In the next step, the plate is taken to a finishing table where various acid bath chemicals smooth the finish of the plate. Finally, the plate is transferred to a registration table where it is registered and precisely applied to a print cylinder. The cylinder is then taken to the press facility for operations.

A plate drill apparatus such as that described in a pending application of the present inventor, U.S. application Ser. No. 857,149, can be used in the above outlined procedure to drill the necessary holes in a flexible printing plate. This plate drill apparatus in particular is adjustable to accommodate various sizes of printing plates. Further, this plate drill apparatus includes a positioning means which aids in drilling the plate in a selected alignment. However, any other suitable plate drill means may be used in conjunction with the present registration table.

Referring in detail to FIGS. 2, 3, 4 and 5, the registration table 1, is designed to mount the imaged and processed flexible printing plate 3 to a plate cylinder 5 located adjacent the registration table 1, FIG. 2. In the illustrated example, the registration table 1 has basal support members forming an open framework 7, generally rectangular in shape, with opposed, spaced-apart front and back frame members 9 and 11 and opposed, spaced-apart side frame members 13 and 15. This framework 7 may be of square tube steel construction.

The framework 7 is mounted on top of a work table surface 17 and has front and rear supportive legs. In the illustrated example, the rear legs consist of a rear channel beam 19 extending between opposed rear corners of the framework 7. The front legs 25 are located at opposed front corners of the framework 7. The front legs 25 may be adjustable, including a threaded screw 31 received into a bore 33 located within respective tower portions 35 of the front legs 25. A thumb wheel 37 is located at the bottom end of the threaded screw 31 for adjustment.

The tower portion 35 has a U-shaped slot 39 in which slide blocks 41 are fitted. The slide blocks 41 are located at opposed ends of an axle 43 on which the plate cylinder 5 is axially mounted. As the thumb wheel 37 adjusts the screw 31 upwardly, an upper end of the screw bears upon the slide block 41 to urge it upwardly, and raise the cylinder 5. Conversely, when the thumb wheel 37 adjusts the screw 31 downwardly, the slide block 41 is lowered, and the cylinder 5 is lowered.

The table 1 includes left and right upper, coplanar work surfaces 45 and 47, of substantially equal size, and which are spaced apart to form a channel 49 therebetween, with a track located within the channel 49. The work surfaces 45, 47 have respective aligned front edges 51.

Spacer blocks 85 extend between the side frame members 13 and 15 and the front and rear frame members 9 and 11 relative to the overlying left and right work surfaces 45 and 47 to position the latter in spaced relation to the framework 7. Flush mounted screws 86 interconnect the parts.

In the illustrated embodiment, the track comprises a rail 55, which is an elongated rod with opposed ends 57 and 59. The opposed rod ends 57 and 59 are secured within front and rear mounting blocks 61 and 63, which are respectivly positioned medially and extending upwardly from the front and back frame members 9 and 11 of the basal support frame work 7. Each mounting block 61 and 63 includes basal mounting flanges 65 and a receiving aperture 67 through which the respective rail end 57 or 59 extends. The mounting blocks 61 and 63 have split tensioning ears connected by adjustable threaded fasteners 66 to securely hold the rod in place.

The rail 55 is positioned perpendicular to the front edges 51 of the work surfaces 45 and 47 and extends through the channel 49 between the left and right work surfaces 45 and 47. A rail engaging member, such as a pillow block 69, is slideably positioned on the rail 55 by means of a longitudinally split tubular bearing 71 mounted within the pillow block 69. The pillow block 69 has a tensioning means such as screws extending therein to frictionally regulate the sliding movement of the pillow block 69 along the rail 55.

A plate mounting platform 75 is affixed atop the upper surface of the pillow block 69 and forms a plate mounting surface means for the flexible printing plate 3. The platform 75 is generally rectangular in shape with opposed, parallel front and back edges 77 and 79 and side edges 81 and 83. The platform 75 has planar upper and lower surfaces and slides freely along the underlying coplanar work surfaces 45 and 47. The plate mounting platform 75 is movable toward and away from the front edges 51 of the work surfaces by movement along the perpendicularly situated rail 55 by sweeping the plate mounting platform 75 atop the left and right work surfaces 45 and 47 by pulling or pushing force. The front edge 77 of the plate mounting platform 75 has a beveled edge to aid in properly registering the cylinder 5 with the printing plate 3.

The plate mounting platform 75 contains an array of pin holes 87 for inserting pins 89 therein and pinning the printing plate 3 thereto. In the illustrated example, three paired sets of pin holes 87 are provided in order to accommodate printing plates 3 of a variety of widths, thereby adding to the versatility of the present invention. The pin holes 87 are preferably positioned adjacent the front edge 77.

The axle 43 extends through the axial opening of the plate cylinder 5, as described above. The slide blocks 41 are located at opposed ends of the axle 43 and fit within the respective U-shaped slots 39 of the tower portions 35 of the front legs 25 of the framework 7 to provide support for the cylinder 5. As the slide blocks are raised and lowered as discussed above, the plate cylinder 5 is accordingly raised or lowered in order to properly position the plate cylinder 5 to adjust it into even contact with the printing plate 3 after the plate mounting platform 75 is moved toward the plate cylinder 5. In this position, the longitudinal axis of the plate cylinder 5 is perpendicular to the track 53 on which the plate mounting platform 75 is mounted, and parallel to the front edges 51 of the left and right work surfaces 45 and 47. This assures proper registration of the printing plate 3 with the plate cylinder 5.

In use, the printing plate 3, pre-drilled medially by a drilling apparatus such as discussed above and with the drill bores aligned with the image thereon, is processed, and after processing is brought to the registration table 1. The pins 89 are used to attach the printing plate 3 to the plate mounting platform 75 and hold the plate 3 securely in place to assure registration with the plate cylinder 5 while the printing plate 3 is applied to the cylinder 5. The printing plate 3 overhangs the front edges 77 of the platform 75 so that it can be rolled onto the cylinder 5 as described below. To mount the printing plate 3, the plate cylinder 5 is covered with a double sided, sticky backed tape in the area of contact between the surface of the cylinder 5 and the plate 3. The plate mounting platform 75, with the printing plate 3 attached thereto, is drawn toward the work surface front edges 51 and the overhanging lip of the printing plate 3 is adhered to the plate cylinder 5. The plate cylinder 5 is gradually rotated, applying more of the printing plate 3 to the cylinder surface, pulling the platform 75 therewith, until no more of the plate 3 can be withdrawn because of the plate 3 being pinned to the plate mounting platform 75. The pins 89 are then removed, and as the plate 3 is sufficiently secured to the cylinder 5, the remainder of the plate 3 can be rolled onto the cylinder 5 without shifting of the plate 3 from registration.

By this procedure, orientation of the printing plate 3 to the longitudinal axis of the plate cylinder 5 need only be done once, at the drilling apparatus, and from that point onward registration of the printing plate 3 with the plate cylinder 5 is as easy as merely pinning the printing plate 3 to the plate mounting platform 75 and then rolling the printing plate 3 onto the plate cylinder 5. This procedure saves many hours of work and results in substantially perfect registration of the selected longitudinal axis of the image with the longitudinal axis of the plate cylinder 5.

It is to be understood that while one form of this invention has been illustrated and described, it is not to be limited to the specific form or arrangement of parts herein described and shown, except insofar as such limitations are included in the following claims.

What is claimed and desired to be secured by Letters Patent is as follows:

1. A registration table for mounting a flexible printing plate to an adjacent plate cylinder and comprising:

(a) a table supported on a framework with legs and having left and right upper, coplanar work surfaces spaced apart from said framework by spacer means, said left and right work surfaces separated by track means;

(b) plate cylinder support means secured to said planar work surfaces for maintaining a plate cylinder relative thereto, with a longitudinal axis of said plate cylinder perpendicular to said track means;

(c) means for slideably mounting a plate mounting platform to said track means, said slide means having adjustable tensioning means, and being movable toward and away from said plate cylinder for sweeping said plate mounting platform along atop said left and right work surfaces;

(d) a plurality of pins for medially removably securing a flexible printing plate to said plate mounting platform by extending through pre-drilled holes in said printing plate and into selected ones of an array of holes in said plate mounting platform; and (e) whereby when said plate mounting platform with said printing plate thereon is moved toward said plate cylinder, said printing plate is rolled onto said plate cylinder in registration with said longitudinal axis thereof.

2. The registration table as set forth in claim 1 wherein:

(a) said track means includes an elongated rod; and (b) a pair of mounting blocks are each positioned at an opposed end of said framework;

(c) each opposed end of said rod is affixed within one of said mounting blocks by securing means.

3. The registration table as set forth in claim 2 wherein:

(a) said rod securing means includes split tensioning ears on each of said blocks, which are connected by an adjustable threaded fastener to securely hold said rod.

4. The registration table as set forth in claim 1 wherein:

(a) said plate cylinder support means includes an axle on which said plate cylinder is axially mounted;

(b) a pair of slide blocks are each fitted on an opposed end of said axle; and (c) a pair of tower members are each located adjacent a front leg of said framework and have a U-shaped slot therein, with adjusting means thereon for raising and lowering a bottom portion of said slot;

(d) whereby when said slide blocks are fitted within said slot, said adjusting means raise and lower said slide blocks to raise and lower said plate cylinder for proper registration of said plate cylinder with said flexible printing plate.

5. The registration table as set forth in claim 2, wherein:

(a) said slideable mounting means includes a track engaging member on which said plate mounting platform is secured, said track engaging member being frictionally slideably secured to said rod by a longitudinally split tubular bearing mounted within said track engaging member.

6. The registration table as set forth in claim 1, wherein:

(a) said plate mounting platform is approximately rectangular and planar, the plane of said platform being parallel to the plane of said left and right work surfaces.

7. The registration table set forth in claim 1, wherein:

(a) said spacer means includes a plurality of cylinders of pre-selected length which are flush mounted on threaded fasteners extending from said work surfaces through said spacers and to threaded bores in said framework.

8. A registration table for mounting a flexible printing plate to an adjacent plate cylinder and comprising:

(a) a table including frame support means and having an upper, planar work surface;

(b) plate cylinder support means including spaced cylinder axle support arms, including respective ends, extending outwardly of said table substantially coplanar to said work surface; said arms being spaced to support a plate cylinder located therebetween and with opposite ends of a cylinder axle supported by said arms;

(c) cylinder height adjustment means located in each of said arm ends and including tower means having a vertical slot therein, and slide blocks with means for vertical adjustment mounted in said tower means and receiving said axle ends for independent vertical adjustment and squaring of said plate cylinder to said work surface;

(d) track means in said table extending perpendicularly to a longitudinal axis of said plate cylinder;

(e) plate mounting platform means and means movably mounting said plate mounting platform means to said track means for forward and rearward sweeping of said plate mounting platform means on said table; and (f) means for removably mounting a flexible printing plate to said plate mounting platform means; whereby when said plate mounting platform means with said printing plate is moved toward said plate cylinder, said printing plate is rolled onto said plate cylinder in registration to the longitudinal axis thereof.

9. A registration tale for mounting a flexible printing plate to an adjacent plate cylinder and comprising:

(a) a table of compact size positionable by a user upon a work bench, said table having a frame support means with spaced side frame members and front and rear frame members supporting an upper, planar work surface;

(b) plate cylinder support means including spaced cylinder axle support arms, including respective ends extending outwardly from said side frame members and substantially coplanar to said work surface, said arms being spaced to support a plate cylinder located therebetween and with opposite ends of a cylinder axle supported by said arms;

(c) cylinder height adjustment means located in each of said arm ends and including tower means having a vertical slot therein and slide blocks with means for vertical adjustment mounted in said tower means and receiving said axle ends for independent vertical adjustment and squaring of said plate cylinder to said work surface;

(d) track means in said table extending perpendicularly to a longitudinal axis of said plate cylinder;

(e) plate mounting platform means and means movably mounting said plate mounting platform means to said track means for forward and rearward sweeping of said plate mounting platform means on said table; and (f) means for removably mounting a flexible printing plate to said plate mounting platform means; whereby when said plate mounting platform means with said printing plate is moved toward said plate cylinder, said printing plate is rolled onto said plate cylinder in registration to the longitudinal axis thereof.

* * * * *